US005520397A

United States Patent [19]

Thompson

[11] Patent Number: 5,520,397

[45] Date of Patent: May 28, 1996

[54] VOLLEY BALL GRAVITY FEED PRACTICE APPARATUS

[76] Inventor: Lowell H. Thompson, R.R#1, Grand Forks, N. Dak. 58201

[21] Appl. No.: 415,128

[22] Filed: Mar. 30, 1995

[51] Int. Cl.[6] ..... A63B 69/00

[52] U.S. Cl. ..... 273/411

[58] Field of Search ..... 273/411

[56] References Cited

U.S. PATENT DOCUMENTS

| | | | |
|---|---|---|---|
| 3,897,950 | 8/1975 | Keller | 273/411 |
| 4,798,390 | 1/1989 | Dooley | 273/411 |

*Primary Examiner*—William H. Grieb
*Attorney, Agent, or Firm*—Robert E. Kleve

[57] ABSTRACT

The invention comprises a volley ball gravity feed practice striking apparatus. The apparatus has a basket at one end for storing volley balls, and a volley ball guideway at the other end, with a triggering mechanism between for advancing volley balls from the basket onto the guideway. The apparatus is adapted to be positioned at the upper end of a pole or standard, with the basket adjacent the pole and with the basket and guideway inclined slightly downward and away from the pole, with the pole mounted on a movable platform so that the pole and apparatus may be positioned on a volley ball court or floor parallel in length to a volley ball net stretched in operative use across the floor. The basket is of a size to receive a plurality of volley balls. The triggering mechanism may be operated to advance volley balls, one at a time, from the basket onto the inclined guideway, with the inclination being sufficient to cause the volley ball once on the guideway to gravitate downward along and forward at an incline toward the outer forward end of the guideway and off the forward end of the guideway. A person or player may advance toward the apparatus and net so as to time their reaching the outer end of the guideway when a volley ball, advanced by the triggering mechanism, reaches the outer end of the guideway, the person may strike the volley ball to practice spiking the ball over the net.

7 Claims, 3 Drawing Sheets

VOLLEY BALL GRAVITY FEED PRACTICE APPARATUS

This invention relates to ball practice apparatus.

It is an object of the invention to provide a novel practice volley ball striking (i.e. spiking, serving, and etc.) having a guideway mounted at the upper end of a pole, with a ball storage basket and guideway with the guideway inclined downward and horizontally away from the basket and pole and a release member to release volley balls so that they may gravitate down along the inclined guideway with the guideway having a flexible, resilient end portion, whereby a person may strike at a volley ball rolling down the guideway to practice striking the ball and may inadvertently strike the lower flexible, resilient end of the guideway while striking at the ball, with the resiliency of the guideway end portion acting to prevent injury to the person striking the guideway while striking the ball.

It is another object of the invention to provide a novel ball feeding apparatus for feeding a ball under a gravity flow along an inclined guideway and a player or operator may practice striking the ball while in motion under a gravity flow motion along the guideway.

It is another object of the invention to provide a novel volley ball practice striking apparatus which places a volley ball in motion along an inclined guideway under a gravity flow along a path across the intended path of movement of an operator, whereby the operator may strike the ball while it travels across his intended path.

It is a further object of the invention to provide a novel volley ball practice apparatus, which places a volley ball in motion under gravity along an inclined guideway with the outer end portion of the guideway being flexible, so a practicing operator may strike the ball while it gravitates down along the guideway, and if the operator strikes the guideway while striking at the ball, the flexibility of the outer end of the guideway will reduce the risk of injury to the operator in striking the guideway.

It is a further object of the invention to provide a novel gravity flow ball feeding device for feeding a ball under gravity flow across the intended path of an operator to enable the operator to strike the ball and practice coordination, timing and strength in striking the ball while in motion.

Further objects and advantages of the invention will become apparent as the description proceeds and when taken in conjunction with the accompanying drawings wherein:

BRIEF DESCRIPTION OF PREFERRED EMBODIMENT

Briefly stated, the invention comprises a volley ball practice striking or spiking apparatus. The apparatus has a basket receptacle at one end for storing a plurality of volley balls therein. The basket receptacle is mounted at its rearward end to a pole. A U shaped guideway has the outer spaced legs mounted to the forward end of the receptacle and is inclined forward and downward with its U shaped end at its forward downward end and is inclined forward and downward sufficiently to cause a volley ball, when placed on the guideway to roll, under gravity, forward and downward along the guideway and off its forward U shaped end. A triggering mechanism is mounted to the apparatus, between the basket receptacle and the guideway. The mechanism has a lever for operating the arm of the mechanism, which upon movement of the arm in one direction acts to push one of the volley balls in the receptacle onto the guideway, while the arm prevents any other volley ball in the basket from traveling onto the guideway during the advancing of the one volley ball. The triggering mechanism has a spring return to return the arm to previous position to be ready to advance another volley ball in the receptacle onto the guideway. The apparatus may be mounted on the pole at various heights such as just above the height of a volley ball net on one side of the net, with the guideway running parallel to the length of the net.

One person may operate the triggering mechanism, to advance volley balls, one at a time, from the basket onto the guideway so that they may gravitate down along the guideway. This enables a practicing person wishing to practice striking the ball, while in motion, to attempt to time his advance to the net and the outer end of the guideway so as to jump and strike the ball as it reaches the outer end of the guideway to simulate practicing striking or spiking the ball, as it would be struck in spiking, serving, or in striking a down ball.

Figure 1:
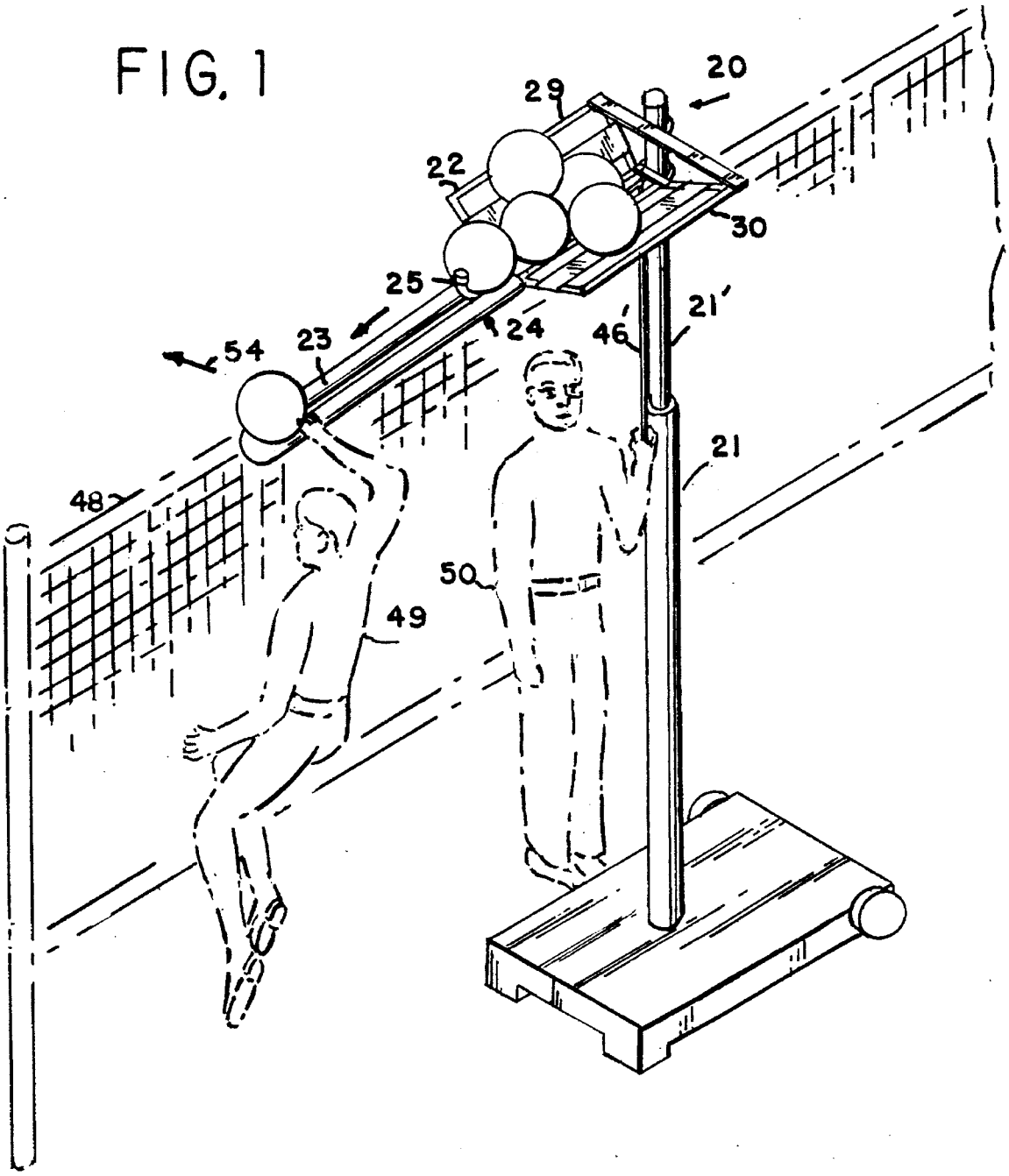
FIG. 1 is a perspective view of the volley ball gravity feed practice strike apparatus shown attached to the top of a pole and positioned to one side of a volley ball net. The apparatus is shown being operated by an apparatus operator for use by a practicing operator. The apparatus has a basket like receptacle at one end which is mounted to the pole, with an inclined guideway extending away from the receptacle and pole and inclined downward away from the receptacle. A triggering mechanism is mounted on the apparatus between the receptacle and the guideway and may be operated to release volley balls stored in the basket receptacle onto the guideway, so that they may roll, under the action of gravity, downward along the guideway toward the lower outer end of the guideway. The practicing operator, wishing to practice striking the ball while it is traveling down toward the end of the guideway, may advance toward the apparatus and strike at the ball, attempting to time the strike to coincide with the ball reaching the outer end of the guideway, such as shown in the drawing.
Figures 2, 6:
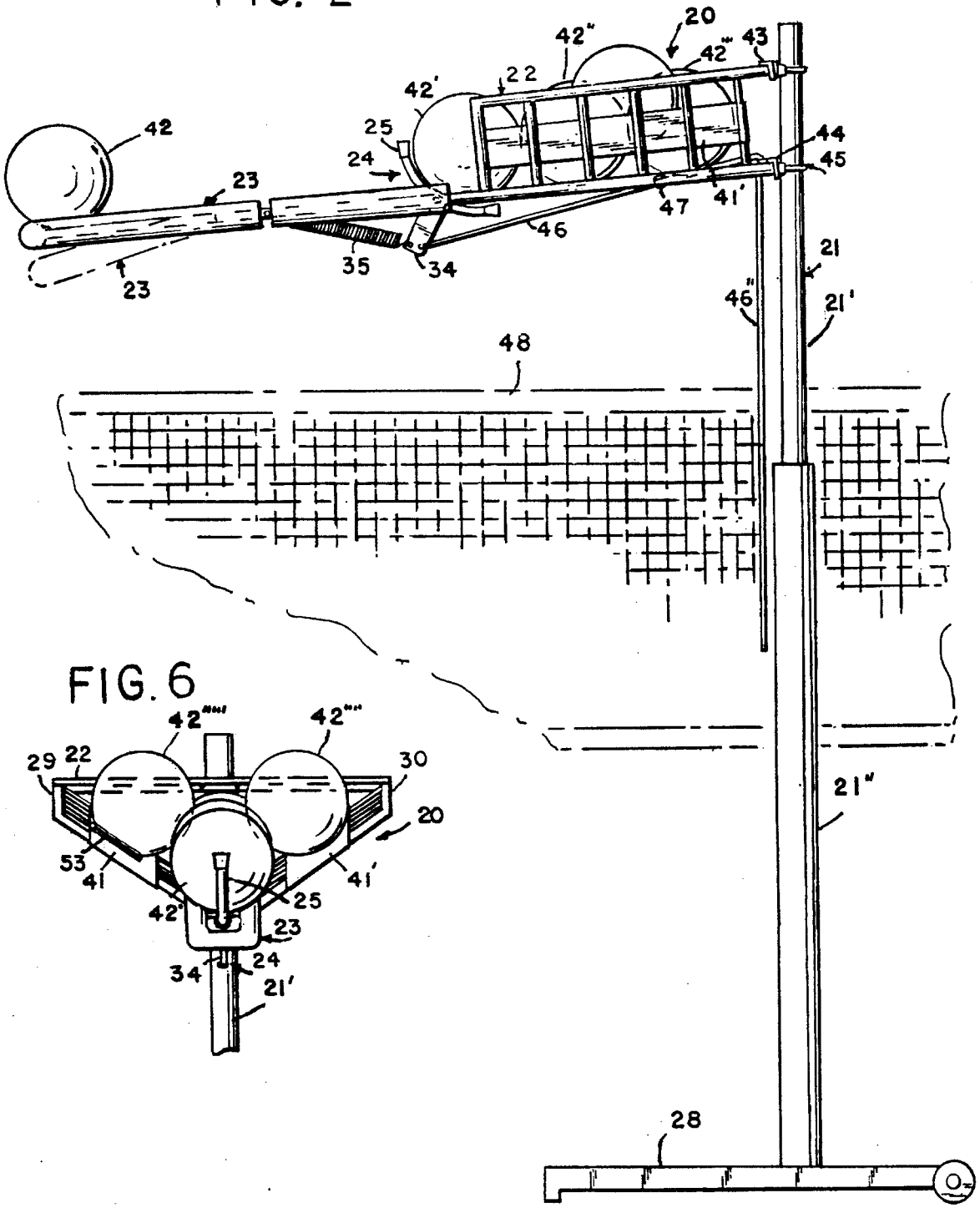
FIG. 2 is an enlarged side elevational view of the volley ball gravity flow apparatus.
FIG. 6 is a similar front view of the invention, with a volley ball having rolled down to the forward end of the guideway.

Referring more particularly to the drawings, in FIGS. 1 and 2 the volley ball gravity feed practice striking or spiking apparatus 20 is shown. The apparatus 20 is mounted on a pole 21. The apparatus 20 has a basket or receptacle structure 22 at its rearward end, and the rearward end 22' of the basket is mounted to the upper portion 21' of the pole. A volley ball guideway structure 23 is mounted to the forward end of the basket. A triggering mechanism 24 is mounted to the apparatus between the guideway and the basket or receptacle. The triggering mechanism 24 has a C shaped volley ball advancing 25. The advancing arm 25 is pivotally mounted intermediate its ends 25' and 25" to a rod 24', and the rod 24' is fixed between a pair of metal parallel rods 23 and 23' which extend along the center of the guideway 23. The rods 23 and 23' at their rearward ends 26 and 27 extend along the bottom of the basket 22 and form the bottom of the basket 22.

The basket 22 has a pair of upward inclined opposing side frames 29 and 30, which extend upward from the rearward ends 26 and 27 of of the parallel rods 23 and 23' and also outward at an inclined angle. The side frames 29 and 30 each have parallel rods 31 and 32 extending upward along the front and rear of the side frame, and upper bordering rods which connect the front and rear rods together to form the respective side frames 29 and 30.

The C shaped advancing arm 25 has a lever 34 fixed to the middle portion of the arm and extends outward from the arm near the pivot 24'. A coil spring 35 has one end attached to the lever 34 and its other end attached to the rod 33, fixed between the parallel rods or legs 26 and 27. The spring 35 is under expansion and it urges the lever 34 to pivot the C shaped advancing arm 25 clockwise to the right, pivoting about pivot 24' to its position in solid lines in FIG. 3, for receiving a volley ball from the basket 22, under a gravity flow movement of the volley balls 42 downward along the rods 26 and 27 of the basket 22 of the apparatus 20.

The U shaped guideway 23 has a tubular sleeve member 36 made of thick polyethylene foam in a pipe or tubular shape. The ends 36' 36", being tubular are bent into parallelism with one another and are telescopingly fitted over the foreward outer ends 38 and 38' of the parallel metal legs 23' and 23" of the basket 22. The sleeve 36, being made of polyethylene is resilient and consequently it can be bent downward or upward or to one side by an operator's striking it and it spring back to its original shape and position as shown in solid lines in the drawings.

The portions of the metal rods or arms 23' and 23" adjacent the U shape resilient tubular member 36 are also covered with pipe sections of polyethylene resilient foam 37 and 37' to cushion against the operator striking those portions inadvertently and causing injury to the operator.

The basket side frames 29 and 30 each have a plastic strip 41 and 41' fixed about each frame 29 and 30 to keep any of the volley balls 42 from resting in between the parallel rods 31 and 32 of the side frames 29 and 30.

The rearward end 22' of the basket 22 has an upper and a lower L shaped metal rod 43 and 44. The upper L shape metal rod 43 is fixed laterally across the rear ends of the upper frame rods 33 of the side frame members 29 and 30. The lower L shaped metal rod is shorter than the upper rod and is fixed laterally across the rearward ends of the pipe ends 26 and 27 at the rear of the arms 23 and 23'. The metal rods 43 and 44 each have an L shaped cross section.

A pair of conventional U shaped clamps 45 and 45' each have their parallel ends bolted to the L shaped rods 43 and 44 by nuts threaded onto the outer ends of the rods after the rods have extended through bores in the rods 43 and 44, which bores are smaller than the size of the nuts threaded onto the clamps 45 and 45'.

The U shaped clamps are tightened about the upper pole section 21' which is telescoped into the lower pipe section 21" of the pole 21. The upper U shaped clamp 45 has sufficient washers 45", fitted between the upper pipe section 21' and the L shaped cross member 43, to tilt the apparatus 20, including the basket 22 and guideway 23, when viewed from FIGS. 2 and 3, downward slightly from horizontal to the left at approximately a 5 degree angle downward from horizontal to provide a incline downward toward the U shaped end of the resilient sleeve member 36 at the forward outer end of the guideway. This angle is sufficient to cause a volley ball 42 once placed upon the foam pipe sections 37 and 37' of the guideway or the resilient sleeve member 36 at the forward end of the guideway, to roll downward under gravity along the guideway 23 and off the U shaped end of the U shaped sleeve member 36 of the guideway, under ordinary circumstances. The angle may be varied by a additional or less washers being placed between cross member 43 and the upper pipe section 21' if desired. Also, the washers may be slotted into a C shape if desired for easier attachment to the clamp.

A rope 46 has one end attached to the outer end of the leg 34 of the C shaped advancing arm 25 and extends rearward through a loop 46', fixed to the bottom of the middle of the rear rod 44. From there, the rope extends downward with its other end spaced above the ground. A ball 47 is mounted to an intermediate portion of the rope to engage upward against volley balls positioned in the basket and resting on the rear rod portions 26 and 27 to agitate them and cause them to roll along the rod sections downward along the guideway toward the C shaped advancing arm 25.

Operation:

The volley ball gravity feed practice spiking or striking apparatus invention 20 operates as follows:

The apparatus invention 20 has a pole 21 which extends downward from the apparatus 20' and the apparatus 20' will be adjusted in height by raising and lowering the telescoping section 21' in the lower pole section 21" of the pole 21 and be locked in place by a conventional locking screw. The pole 21 of the invention 20 is mounted on a platform 28 which rests on the floor or ground.

The apparatus invention 20 will be placed in position on the floor where a conventional volley ball net 48 has mounted upright across the floor between two poles, so as to be placed in position parallel to the volley ball net as generally illustrated in FIG. 1, and so as to place a volley ball 42, when it gravitates or rolls down to the guideway 23 to the lower U shaped end 36" of the resilient sleeve in a typical position for spiking or hitting the volley ball over the net by a person 49. The invention may also be placed further back away from the net and lowered to by struck to simulate serving the ball over the net.

Figure 3:
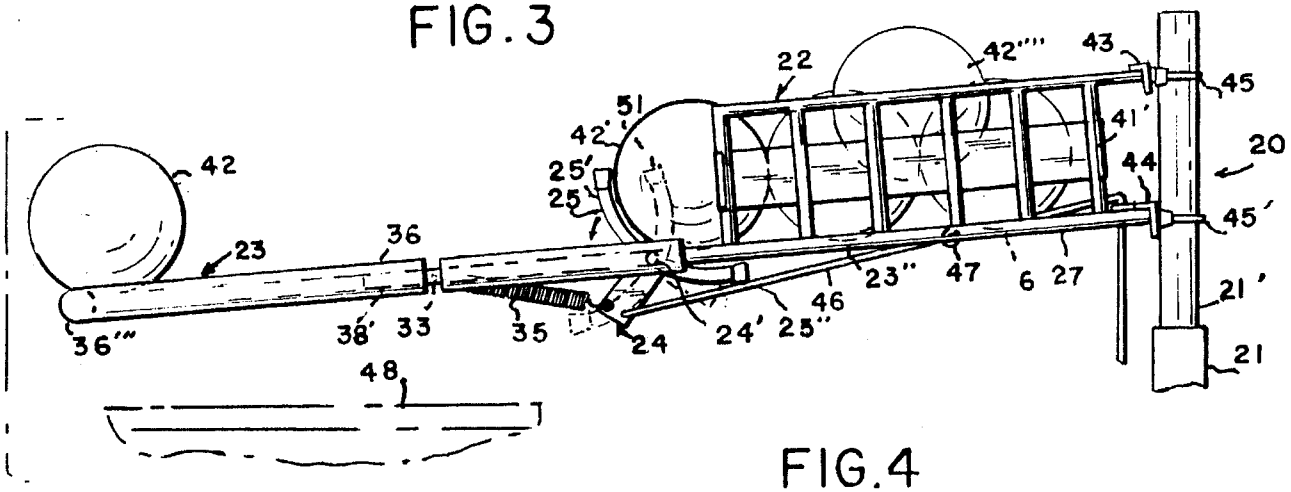
FIG. 3 is a further enlarged side view of the volley ball gravity flow strike apparatus.

The platform 28 is fixed to the bottom 21" of the pole and rests directly on the floor to support the pole and apparatus where the volley ball net is mounted as shown in FIG. 1, with the pole 21 extending vertically upward and with the apparatus 20' inclined slightly forward and downward at a 5 degree angle downward from horizontal as generally shown in FIGS. 1,2 and 3.

A plurality of conventional volley balls 42, upto and including five may be tossed up into the basket 22 and be retained in the basket, as shown in FIGS. 1–4, and 6. Three of these volley balls 42 will be able to rest in a line in the V shaped bottom of the basket 22, on the rods 26 and 27, so as to be able to gravitate forward and downward along the rods in the basket, one after another to the advancing arm 25 with the two additional volley balls gravitating to the arm afterwards.

An apparatus operator 50 will stand beside the apparatus and net 48, and will pull the other end 46" of the rope 46 downward, when a person 49 who intends to practice spiking the ball from the same side of the net is ready.

Pulling the other end of the rope downward, pulls the lever 34 counter clockwise when viewed from FIG. 3, which pivots the C shaped advancing arm or rod 25 counterclockwise about pivot 24' from its position in solid lines in FIGS. 2 and 3 to its position in phantom lines 51 in FIG. 3. This counterclockwise movement of the arm 25 causes its right hand portion 25" to extend or pivot upward between the volley ball 42', immediately adjacent the arm 25, and the next volley ball 42" rearward in line along the bottom of the basket on the rods 23' and 23" so as to be behind the volley ball 43' and pivot it upward onto the resilient sleeve pipe sections 37 and 37', where it will start to roll under the effect of gravity, along the sleeve sections 37 and 37' and along the end sleeve portions 36' and 36" toward the U shaped end 36''' of the resilient sleeve 36.

Simultaneously with the pivoting or lifting of the volley ball 42' onto the sleeve sections 37 and 37' by the upward movement of the right end 25" of the C shaped arm, this upward movement blocks the next volley ball 42" in line in the basket from gravitating or advancing toward the the advancing arm while the arm is in this position. Once the operator 50 releases the rope, the spring biasing of the spring 35 upon the arm 25 will urge the arm back to its position shown in solid lines in FIGS. 1 and 3, and now the next volley ball 42" in line is free to and may forward against the upward raised left portion 25' of the advancing arm 25, which prevents the volley ball from advancing further while in this position until the rope is pulled again. The pivoting of the left portion 25' downward when the rope 46 was pulled freed the ball 42' immediately adjacent that left end 25' of the arm so that the right end 25" of the arm could pivot the volley ball 42' to the left onto the sleeve members 37 and 37' and to enable the ball to be free of the left portion 25' of the arm so that the volley ball can gravitate to the left along sections 37 and 37' and ends 36 and 36' onto and off the left end 36''' of the guideway.

As the volley ball 42' rolls down the guideway 23, the operator 49, practicing spiking, will advance rapidly toward the net 48 and, if right handed, will jump up upon reaching the net and strike the ball 42' with his right hand, if the operator 49 has timed his advance properly, just as the ball reaches the U shaped end 36''' of the resilient sleeve to spike the ball over the net 48 to the other side as shown generally in FIG. 1.

Figure 4:
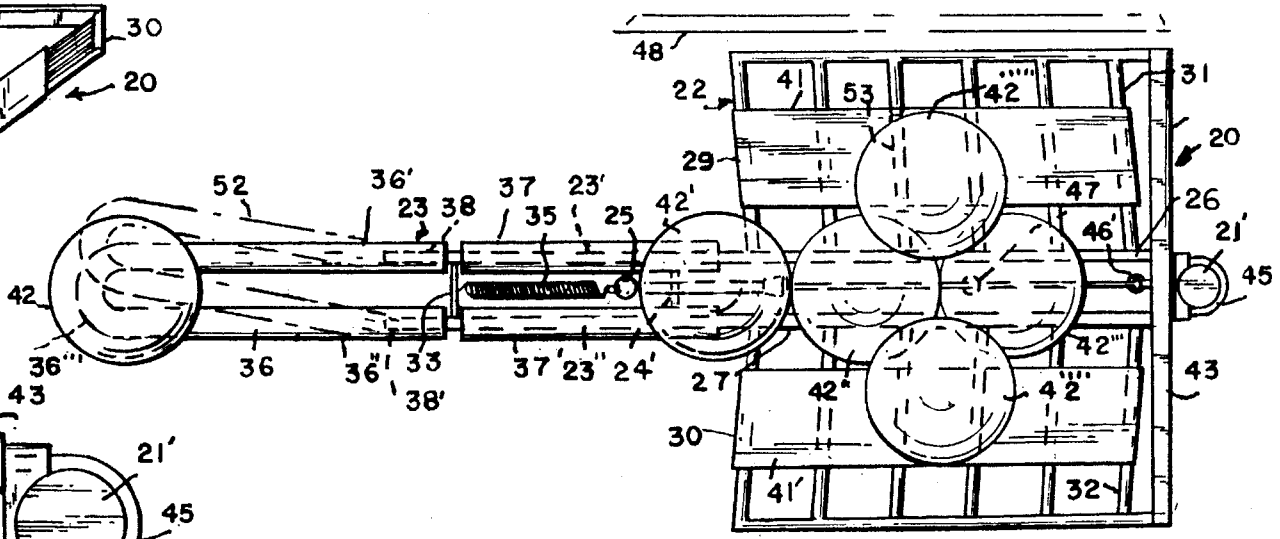
FIG. 4 is a top plan view of the volley ball gravity flow practice strike apparatus.
Figure 7:
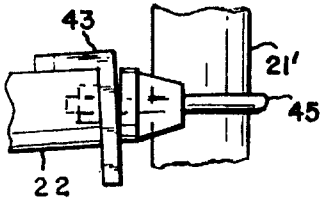
FIG. 7 is a cross-sectional view of the upper one of the adjustable mounting pole brackets for mounting the apparatus to the pole, taken along line 7—7 of FIG. 5.
Figure 5:
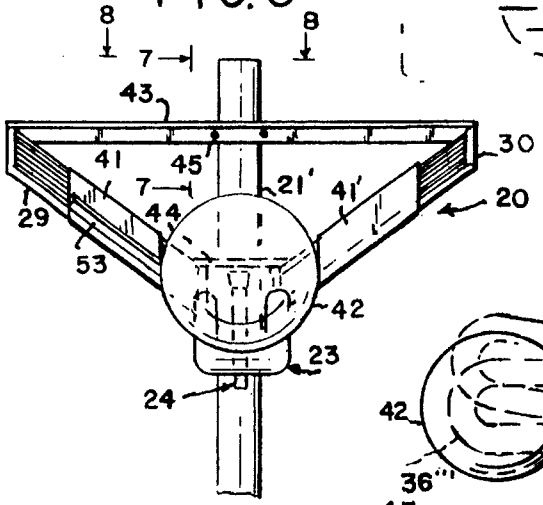
FIG. 5 is a front elevational view of the volley ball practice striking invention, with the basket receptacle loaded with five volley balls and ready to trigger one of the volley balls forward onto the guideway so that it may roll down the guideway.
Figure 8:
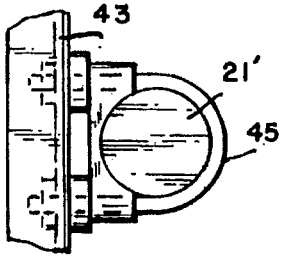
FIG. 8 is a cross-sectional view taken along line 8—8 of FIG. 5.

Since the U shaped resilient sleeve 36 has only its remote rearward ends of side sleeve end portion 36' and 36" mounted on the foreward ends 38 and 38' of the parallel rods 23' and 23", the resilient sleeve 36 may be struck by the practicing operator's right hand, while striking the volley ball 42' at the end 36''' of the sleeve, and the sleeve 36 will give or bend along the direction the hand is moving as shown in phantom lines 52 in FIG. 4 because of its resiliency and it will resume its position shown in solid lines springing back thereafter. The striking of the sleeve will not cause injury to the operator's hand or adjacent arm portion because of its give or flexing, as there is no hard metal rod inside the sleeve 36 in this forward end that might in some way cause injury otherwise to the practicing operator in striking this portion. The striking or spiking of the volley ball 42' will cause it to travel further away from the net, as indicated by the arrow 54.

This spiking of the ball improves the timing of a practicing operator so as to tend to improve his performance when spiking a volley ball in an actual volley ball game. The practicing operator may thereafter return to his former position further away from the same side of the net, and the apparatus operator 50 may again pull the other end 46" of the rope 46 down, pivoting the arm 25 counterclockwise again. This advances the next volley ball 42" in line up onto the sleeves 37 and 37' where it will also gravitate down along the sections 37 and 37' and ends 36' and 36" toward the U shaped end 36'''. The practicing operator may again advance toward this next volley ball 42" and strike and spike this volley ball in a similar manner to the last. The third, fourth, and fifth volley balls will advance into the position of volley ball 42', under the action of gravity one after another each time the arm 25 is pivoted to advance a volley ball, so that the spiking action may continue until all five volley balls have been advanced and have gravitated down the guideway to be spiked or attempted to be spiked or struck by the practicing operator when they reach the lower outer end of the guideway.

A rib 53 is fixed to the plastic strip 41 on the one side frame 29 to prevent the fifth volley ball 42'''', resting on the side frame 29, from traveling forward horizontally along the side frame beyond that strip 41 until after it has gravitated downward onto the rear ends 26 and 27 of rods 23' and 23" on the bottom of the basket 22. This rib and its action also causes the fourth volley ball 42'''', resting on the other side frame 30, to gravitate downward and forward slightly ahead of the fifth volley ball, so that the fourth volley ball 42'''' reaches the rear ends 26 and 27 of the rods first, so that the fourth volley ball will gravitate along the rear portions 26 and 27 of the rods to the advancing arm 25 first, ahead of the fifth volley ball, to thereby determine which order these two balls will reach the bottom of the basket forward of the other.

The ball 47 on the rope 46 will engage the underside of the rear volley ball resting on the rear portions 26 and 27 of the rods as the rope 46 is pulled downward at its other end 46", and this action will agitate the volley balls resting on the rear portion 26 and 27 of the rods to cause them to be free to roll easily down the rear portions 26 and 27 of the rods under gravity to the advancing arm 25.

Thus it will be seen that a novel volley ball practice spiking or striking apparatus has been provided which enables a practicing operator to practice such things as spiking or hitting a volley ball over the net, if the practicing operator is on the same side of the net as the apparatus, while the volley ball is in motion rolling down to the end of the guideway. The apparatus further enables a practicing operator to practice serving, by moving the apparatus further away from the net and lowering the apparatus toward the floor somewhat, so that the practicing operator may strike the ball without having to jump upward, for example.

It will be obvious that various changes and departures may be made to the invention without departing from the spirit and scope thereof, and accordingly, it is not intended that the invention be limited to that specifically described in the specification or as illustrated in the drawings, but only as set forth in the appended claims wherein:

What is claimed is:

1. A volley ball gravity feed practice strike apparatus comprising a vertical pole, a basket have and open top and an open forward end, said basket being mounted at a rearward portion to an upper portion of said vertical pole, said basket having a flexible resilient guideway mounted to the forward end of said basket, said basket and guideway being inclined forward and downward at a shallow angle, a volley ball advancing mechanism mounted to said forward portion of said basket rearward of the forward end of said resilient guideway, said basket acting to align volley balls in the basket in a row front to rear, said advancing mechanism comprising a movable rod projecting in in front of the basket to block the forwardmost of the volley balls, means to move said movable rod out of a blocking position in front of said forward most valley ball and project forwardly against the rear of the forward most volley ball to project the forwardmost of the volley balls forward along the guideway with the forwardmost of the volley balls upon being projected by the rod enable to roll downward along the guideway and drop off the forward end of the guideway, said forward end of said guideway being free of surrounding obstacles to enable an operator to strike the volley ball when it adjacent the forward end of the guideway.

2. A volley ball gravity feed practice striking apparatus according to claim 1, wherein said movable rod upon projecting forwardly against the rear of the forwardmost volley ball extending upward behind the forwardmost volley ball so as to block the next of said volley balls in the row in the basket from moving forward.

3. A volley ball gravity feed practice striking apparatus according to claim 1 wherein said movable rod is movable back to its first mentioned blocking position after projecting the forwardmost of the volley balls forward to allow the next of the volleyballs in the row to gravitate forward to the forwardmost position of the first mentioned forwardmost volley ball and block the next of the next of the volley balls.

4. A volley ball gravity feed practice striking apparatus according to claim 2 wherein said movable rod has spring means to to move said rod back to its original blocking position, and has rope means movable by a operator to move said movable rod out of its original blocking position and project said forwardmost volley ball forward and block the next of said volley balls in the row from moving forward.

5. A volley ball gravity feed practice striking apparatus comprising a vertical pole, a basket having an open top and an open forward end, said basket being mounted at its rearward end to an upper portion of said vertical pole, said basket having a flexible resilient guideway mounted to the forward end of the basket beneath the open forward end, said basket and guideway being inclined forwardly and downwardly at a shallow angle, said basket acting to align a plurality of volley balls in the basket in a row front to rear, a volley ball advancing mechanism mounted to the forward open end of the basket and rearward of the guideway, said mechanism comprising a pivotal rod projecting horizontally in front of the open end of the basket to block forward movement of the forwardmost of the plurality of volley balls when aligned in the row in the basket, means to pivot said rod out of the blocking position in front of the open end and the forward most positioned volley ball and project the rod forward against a rear portion of the forwardmost positioned volley ball to project the volley ball forward onto the guideway to enable the volley ball to roll down and forward along the guideway and drop off the forward end of the guideway, said forward end of the guideway being free of surrounding obstacles to enable an operator to strike the volley ball when it is adjacent the forward end of the guideway.

6. A volley ball gravity feed practice striking apparatus according to claim 5, wherein said flexible resilient guideway has a U shaped conformation.

7. A volley ball gravity feed practice striking apparatus comprising a vertical pole, basket having a open top and an open forward end, said basket being mounted at its rear portion to an upper portion of said vertical pole, said basket having a resilient U shaped guideway mounted to the forward open end of the basket beneath the forward open end, said basket and guideway inclined forwardly and downwardly at a shallow angle, means to adjust the angle, said basket acting to align a plurality of volley balls in the basket in a row front to rear, a volley ball advancing mechanism mounted to the forward open end of the basket rearward of the guideway, said mechanism having pivotal rod, spring means projecting the forward portion of the rod horizontally in front of the open end of the basket to block forward movement of the forwardmost of the plurality of volley balls when when aligned in a row in the basket, means to pivot said forward portion of said rod out of the blocking position in front of the open end and the forwardmost positioned volley ball and pivot a rearward portion of the rod forward against a rear portion of the forwardmost positioned volley ball to project the volley ball forward onto the guideway to roll down and forward along the guideway and drop off the forward end of the guideway, said forward end of the guideway being free of surrounding obstacles to enable a operator to strike the volley ball when it is adjacent the forward end of the guideway.

* * * * *